US007628740B2

(12) United States Patent
Harrington

(10) Patent No.: US 7,628,740 B2
(45) Date of Patent: Dec. 8, 2009

(54) FINGER LADDER STRAP

(75) Inventor: Michael B. Harrington, Franklin, NJ (US)

(73) Assignee: Micnan Innovations, LLC, Franklin, NJ (US)

( * ) Notice: Subject to any disclaimer, the term of this patent is extended or adjusted under 35 U.S.C. 154(b) by 602 days.

(21) Appl. No.: 10/995,755

(22) Filed: Nov. 23, 2004

(65) Prior Publication Data

US 2005/0233879 A1 Oct. 20, 2005

Related U.S. Application Data

(60) Provisional application No. 60/563,052, filed on Apr. 16, 2004.

(51) Int. Cl.
*A63B 21/02* (2006.01)

(52) U.S. Cl. ..... 482/121; 482/126; 482/907

(58) Field of Classification Search ..... 482/907, 482/906, 49, 47, 24, 29, 139, 121, 126, 48, 482/148; 601/40, 21, 22; 602/21, 22; 84/465; 248/223, 41

See application file for complete search history.

(56) References Cited

U.S. PATENT DOCUMENTS 4,483,502 A * 11/1984 Fast ..... 248/223.41
4,754,499 A 7/1988 Pirie
4,977,621 A 12/1990 Richard
5,209,712 A 5/1993 Ferri
5,284,259 A * 2/1994 Conway et al. ..... 211/73
5,386,916 A * 2/1995 Valiulis ..... 211/113
5,518,486 A 5/1996 Sheeler
5,624,359 A 4/1997 Dean
5,692,236 A 12/1997 Prince
6,006,929 A * 12/1999 Leonard ..... 211/113
6,071,218 A * 6/2000 Tepperberg ..... 482/121
6,110,075 A * 8/2000 Woodruff ..... 482/47
6,368,255 B1 4/2002 Chan-Rouse
6,382,569 B1 * 5/2002 Schattner et al. ..... 248/74.1
6,532,594 B1 3/2003 Barnett

* cited by examiner

*Primary Examiner*—Jerome Donnelly
(74) *Attorney, Agent, or Firm*—Patterson & Sheridan, LLP; Keith P. Taboada

(57) ABSTRACT

The present invention relates generally to the field of straps and tension devices and specifically relates to a device and method useful for stretching and exercise. In particular, the invention relates to an exercise device. According to one embodiment, the exercise device includes an elongated body having a plurality of columnar ladder apertures and a pad protrusion extending into at least one of the ladder apertures.

12 Claims, 4 Drawing Sheets

FINGER LADDER STRAP

CROSS-REFERENCE TO RELATED APPLICATIONS

This application claims benefit of U.S. Provisional Application Ser. No. 60/563,052, filed Apr. 16, 2004, which is incorporated hereby by reference in its entirety.

BACKGROUND OF THE INVENTION

1. Field of the Invention

The present invention relates generally to the field of straps and tension devices and specifically relates to a device and method useful for stretching, exercise and physical therapy. In particular, the invention relates to a yoga tension device. According to one embodiment of this invention, the device comprises a flat strap. According to another embodiment of this invention, the device comprises a plurality of apertures, at least one aperture further comprising a pad protrusion. According to another embodiment, the invention further comprises a stabilizing opening.

2. Background of the Invention

A Yoga practitioner must assume various positions while performing various Yoga exercises. Many Yoga exercises are complicated and it is difficult to obtain the necessary positions. Assuming a particular position can be difficult without assistance, Yoga practitioners often require the assistance of an extraneous device, such as a cloth strap. Yoga positions must be performed correctly for maximum benefit; therefore, it is desirable to provide a device to assist proper positioning which will enable muscles to relax and stretch in order to obtain a desired position.

Existing stretching devices require repositioning and re-gripping of the hands in order to change or increase stretch positions. This can lead to a break in concentration, complete grip release, and dissipation of the already attained stretch position. A need thus exists for a tension device that allows for small incremental increase of stretch position while eliminating the muscle tension in the hand and forearm commonly associated with other stretching devices. Exercise straps and tension devices have been described (U.S. Pat. No. 6,368,255; U.S. Pat. No. 5,692,236; U.S. Pat. No. 5,624,359; U.S. Pat. No. 5,518,486; U.S. Pat. No. 5,209,712; U.S. Pat. No. 4,977,621; and U.S. Pat. No. 4,754,499). The prior art fails to provide a tension device that allows for small incremental increase of stretch position. Furthermore, the prior art fails to provide a tension device that allows for increasing the stretch without the need to re-grip or reposition.

The present invention provides distinct advantages over the prior art and solves numerous problems long described and understood in the field.

Therefore, there is a need for an improved exercise device.

SUMMARY OF THE INVENTION

It is therefore an object of this invention to provide an exercise device suitable for yoga, exercise and physical therapy. In one embodiment, the exercise device includes an elongated body having a plurality of columnar ladder apertures and a pad protrusion extending into at least one of the ladder apertures.

BRIEF DESCRIPTION OF THE DRAWINGS

A more particular description of the invention, briefly summarized above, may be had by reference to the embodiments thereof illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, wherever possible, to designate identical elements that are common to the figures.

DETAILED DESCRIPTION

The present invention provides a yoga tension device. In one embodiment, the yoga tension device includes a strap having a plurality of ladder apertures, wherein at least one of the apertures comprises an outer edge defining an aperture opening and a pad protrusion, wherein the pad protrusion extends from the outer edge of the aperture into the aperture opening. According to another embodiment of the invention, the strap is flat. According to another embodiment of the invention, the strap is elastic. According to still another embodiment of the invention, the strap is made of plastic. According to another embodiment of this invention, the strap is made of leather. According to another embodiment of the invention, the strap is substantially flexible. The strap is also strong enough to support a tensile strength of approximately fifteen pounds, when tensioned along its length.

According to an embodiment of the invention, the strap has a length of one foot to six feet. According to another embodiment of the invention, the strap has a length of six to eighteen inches. According to an embodiment of the invention, the strap has a width of one foot to three feet. According to another embodiment of the invention, the strap has a width of four to eight inches.

According to an embodiment of the invention, the ladder apertures are sufficient to accept therethrough a portion of a human limb. According to another embodiment, the portion of a human limb is a toe. According to another embodiment, the portion of a human limb is a foot. According to another embodiment, the portion of a human limb is a finger. According to another embodiment of the invention, the ladder apertures have a diameter of one inch to twelve inches. According to another embodiment of the invention, the ladder apertures have a diameter of one-half inch to one inch. The ladder apertures may be substantially circular, semicircular, arc, oral or have another shape.

According to another embodiment of the invention, the strap comprises a plurality of ladder apertures. According to another embodiment of the invention, the ladder apertures are arranged in rows having columnar orientation. According to another embodiment of the invention, the ladder apertures form 2-5 columns. According to another embodiment of the invention, the ladder apertures are approximately equally spaced in three columns. In another embodiment, the ladder apertures are arranged in rows having a center to center distance of about 1-1⅛ inch between apertures within the row and a center to center distance of one inch between rows. The outer ladder apertures of a row may not be linearly aligned with one or more center apertures of the row. For example, a center ladder aperture may be about ¼ inch offset from a line defined between the outermost apertures of a row.

Figure 2:
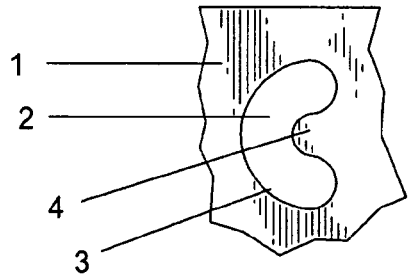
FIG. 2 is a perspective view illustrating a finger aperture of the device illustrated in FIG. 1, showing the displaceable pad.

According to an embodiment of the invention, the ladder apertures comprise an outer edge defining an aperture opening and a pad protrusion, wherein the pad protrusion extends from the outer edge of the aperture into the aperture opening. An aperture may have two or more protrusions, and in one embodiment depicted in FIG. 2A, has two pad protrusions disposed on substantially opposite sides of the aperture. According to an embodiment of the invention, the apertures are approximately semicircle cutouts. According to another embodiment of the invention, the pad protrusion extends into the aperture sufficient to accept therethrough a portion of a human limb. According to still another embodiment, the portion of a human limb causes the pad protrusion to be displaced, thereby forming a cushion beneath the inserted portion of a human limb. According to another preferred embodiment, the pad protrusion aligns with the inside arch of a human knuckle when the strap is gripped.

Figure 2B:
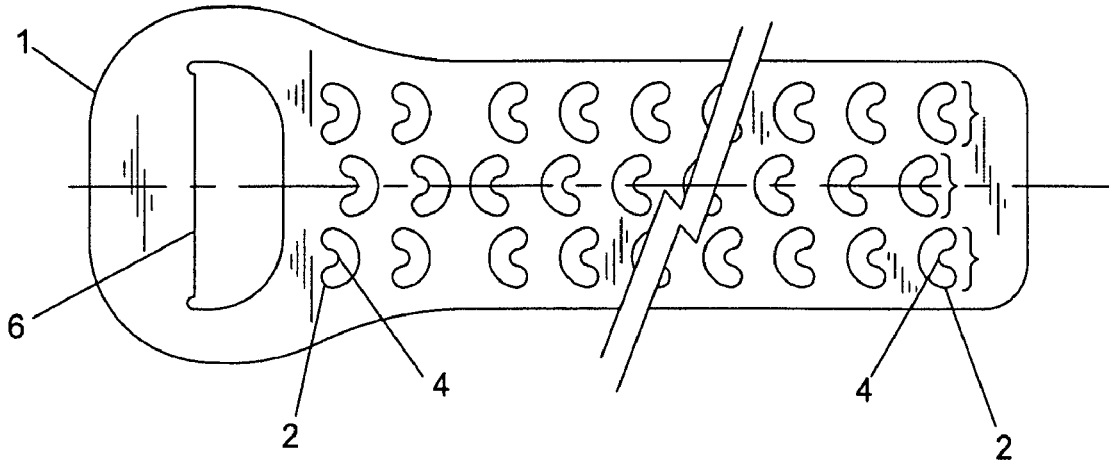
FIG. 2B is another embodiment of a yoga tensioning device.
Figure 2A:
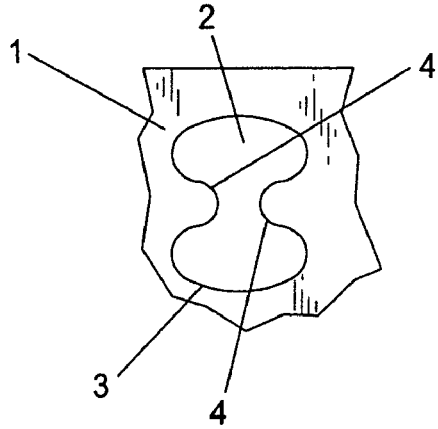
FIG. 2A is another embodiment of an aperture.

The protrusions extending into the ladder apertures at one end of the strap may be orientated opposite, or in the mirror orientation of protrusion extending into apertures at a second end of the strap, as seen in FIG. 2B.

According to another embodiment, the invention further comprises a stabilizing opening. The stabilizing opening is sufficient to accept therethrough a portion of a human limb. The orientation of a major axis of the opening may be non-parallel, in one example, perpendicular, to a major axis of the strap. According to one embodiment, the portion of a human limb is a hand. According to another embodiment of the invention, the portion of a human limb is a knee. According to still another embodiment of the invention, the portion of the human limb is an elbow. According to another embodiment of the invention, the portion of a human limb is a foot. According to an embodiment of the invention, the stabilizing invention is a cutout. According to a preferred embodiment of the invention, the stabilizing opening is proximal to first end of the strap. It is contemplated that the stabilizing opening may be comprised of a separate loop capable of being attached to the strap. The stabilizing opening may include a pad protrusion extending into the aperture defined by the stabilizing opening.

According to an embodiment of the invention, the tension device further comprises an attachment device. According to another embodiment of the invention, the attachment device comprises a means of attaching the strap to an anchor. According to an embodiment of this invention, the means of attaching the strap is a tie. It is contemplated that the tie may be comprised of a number of materials including, but not limited to, plastic, elastic, metal, wood, fiberglass, hemp, cotton, nylon, polypropylene, manila, polyester, polyethylene and cloth. According to a preferred embodiment, the tie is nylon capable of stably attaching the strap to an anchor, such as a chair or rod. According to another embodiment, the attachment device is removable from the flat strap. This embodiment has the advantage of allowing a user to use the device while it is attached to an anchor.

Finally, the present invention provides a method of stretching muscles using the yoga tension device comprising a flat strap having a first end and a second end, and the strap comprising a plurality of apertures, wherein each aperture comprises an outer edge defining an aperture opening and a pad protrusion, wherein the pad protrusion extends from the outer edge of the aperture into the aperture opening. The method comprises insertion of a portion of a first inserted limb through the aperture causing the pad protrusion to be displaced, thereby forming a cushion beneath the first inserted limb portion; and insertion of a portion of a second inserted limb through the aperture causing the pad protrusion to be displaced, thereby forming a cushion beneath the second inserted limb portion. According to an embodiment of the invention, a portion of an inserted limb is a toe. According to a preferred embodiment of the invention, a portion of an inserted limb is a finger.

According to another embodiment of the invention, it provides the method of stretching muscles comprising the steps of insertion of a portion of a first inserted limb through the aperture causing the pad protrusion to be displaced, thereby forming a cushion beneath the first inserted limb portion; and insertion of a portion of a second inserted limb through the aperture causing the pad protrusion to be displaced, thereby forming a cushion beneath the second inserted limb portion, further comprising the steps of moving the first inserted limb in a direction; and moving the second inserted limb in an opposing direction. According to an embodiment of the invention, the opposing direction is opposite the first direction.

According to another embodiment, the invention provides the method of stretching muscles comprising the steps of insertion of a portion of a first inserted limb through the aperture causing the pad protrusion to be displaced, thereby forming a cushion beneath the first inserted limb portion; and insertion of a portion of a second inserted limb through the aperture causing the pad protrusion to be displaced, thereby forming a cushion beneath the second inserted limb portion, further comprising the step of removing the portion of the first inserted limb from the aperture and inserting the portion of the first inserted limb into another aperture, decreasing the distance between the first inserted limb and the second inserted limb, thereby increasing tension on the strap. According to one embodiment of the invention, the columnar orientation of the apertures allows a user to increase tension on the strap. According to a preferred embodiment, the portion of a first inserted limb are two fingers. According to one embodiment, the portion of a first inserted limb are three fingers. According to another embodiment, a first finger is inserted into an aperture and a second finger is inserted into a proximal aperture. According to another embodiment of the method of the invention, the first inserted finger is held stationary, the second inserted finger is then removed from the aperture and inserted into another aperture, decreasing the distance between the first inserted limb and the second inserted limb. According to an embodiment of the invention, the fingers climb along the yoga tension device. This embodiment has the advantage of allowing a user to repeat this method in order to enhance stretching of their muscles in small increments by slowly increasing the tension on the strap, thereby moving into a full stretch position.

According to another embodiment, the present invention provides a method of stretching muscles using the yoga tension device comprising a flat strap having a first end and a second end, and the strap comprising a plurality of apertures, wherein each aperture comprises an outer edge defining an aperture opening and a pad protrusion, wherein the pad protrusion extends from the outer edge of the aperture into the aperture opening, further comprising a stabilizing opening. The method comprises insertion of a portion of a first inserted limb through the stabilizing opening; and insertion of a portion of a second inserted limb through the aperture causing the pad protrusion to be displaced, thereby forming a cushion beneath the second inserted limb portion. According to an embodiment of the invention, the first inserted limb will remain stable in the stabilizing opening. According to an embodiment of the invention, the first inserted limb will remain stable in the stabilizing opening. According to an embodiment of the invention, the insertion of the second inserted limb may be inserted before the first inserted limb is inserted in the stabilizing opening.

A use of the present invention is illustrated by the following example.

EXAMPLE

Stretching the Legs and Back

A user assumes a seated position on the floor, with one leg straight out in front of them. The stabilizing opening is placed over the user's toes and rests on the bridge of their foot. The length of the strap is positioned up the leg toward their knee. From the seated position, the user bends their upper torso forward, stretching toward their toes. Two or three of the user's fingers are inserted into adjacent apertures causing the pad protrusion to be bent toward the floor, thereby forming a cushion beneath the finger. The user then removes one of the fingers and inserts it into another aperture, decreasing the distance between the finger and the foot. This causes the tension in the strap to be increased and allows the user to slowly change their stretch position without releasing the strap. The user is able to continue moving their fingers down the strap toward their foot.

Figure 1:
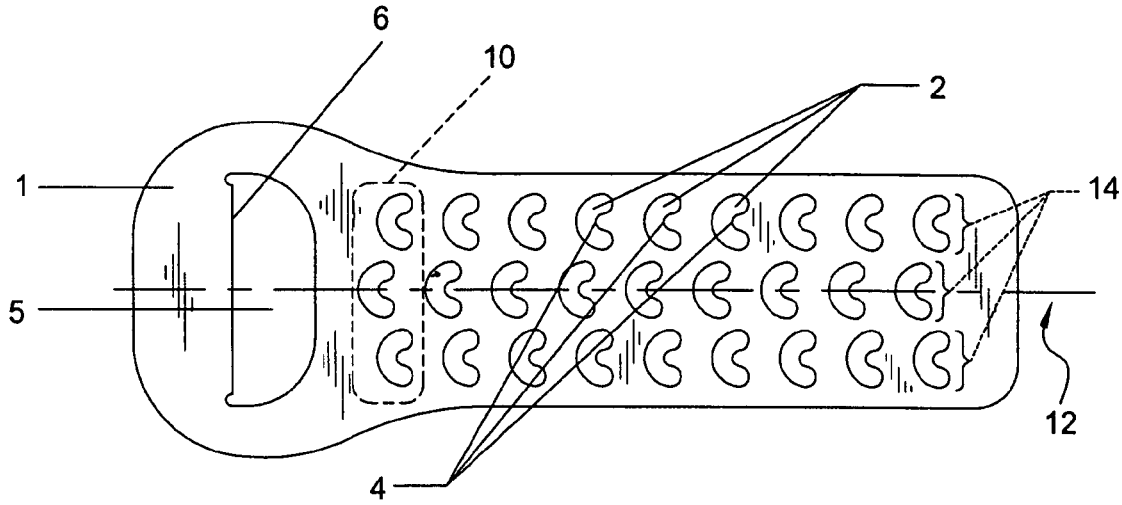
FIG. 1 shows a perspective view of the yoga tension device in accordance with the present invention.
Figure 3:
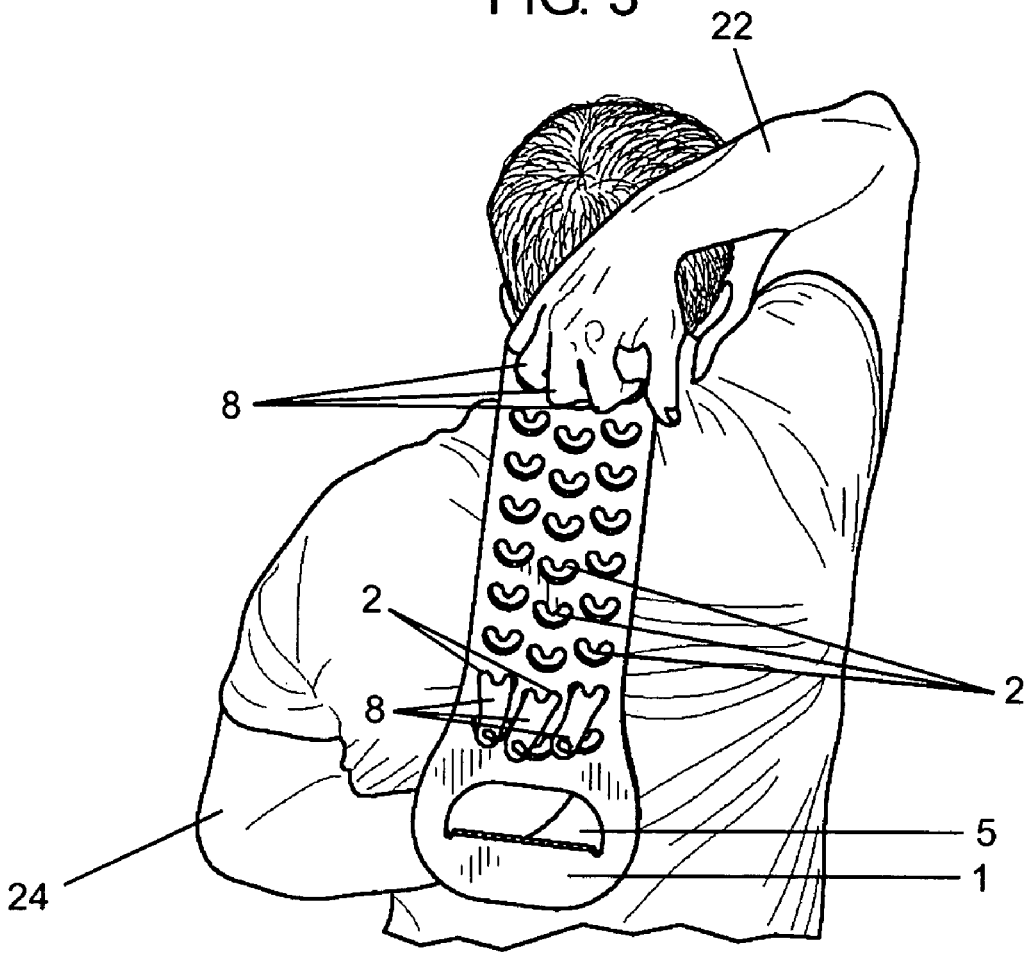
FIG. 3 is a perspective view illustrating a person using the device illustrate in FIG. 1 to stretch the shoulder muscles. Three fingers are inserted into apertures, causing pad protrusions to be displaced. The first arm is raised over the head, the elbow bent, and then the hand is brought to the back of the neck. The second arm is brought behind the lower back and up between the shoulder blades, then the apertures or stabilizing hole is grasped. The upper hand then proceeds to climb downwards, thereby increasing the stretch.
Figure 4:
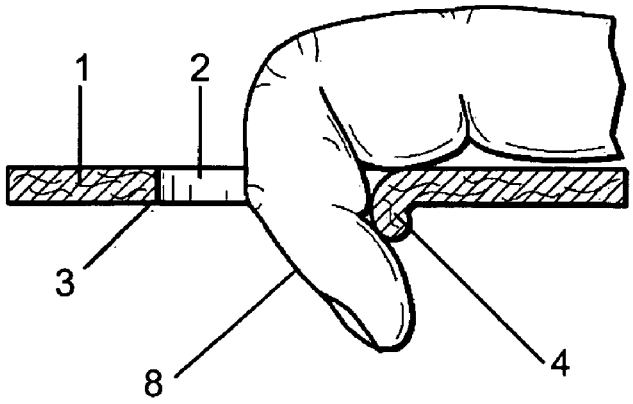
FIG. 4 is a perspective view illustrating a finger inserted into an aperture of the device illustrated in FIG. 1, causing a pad to be displaced.
Figure 5:
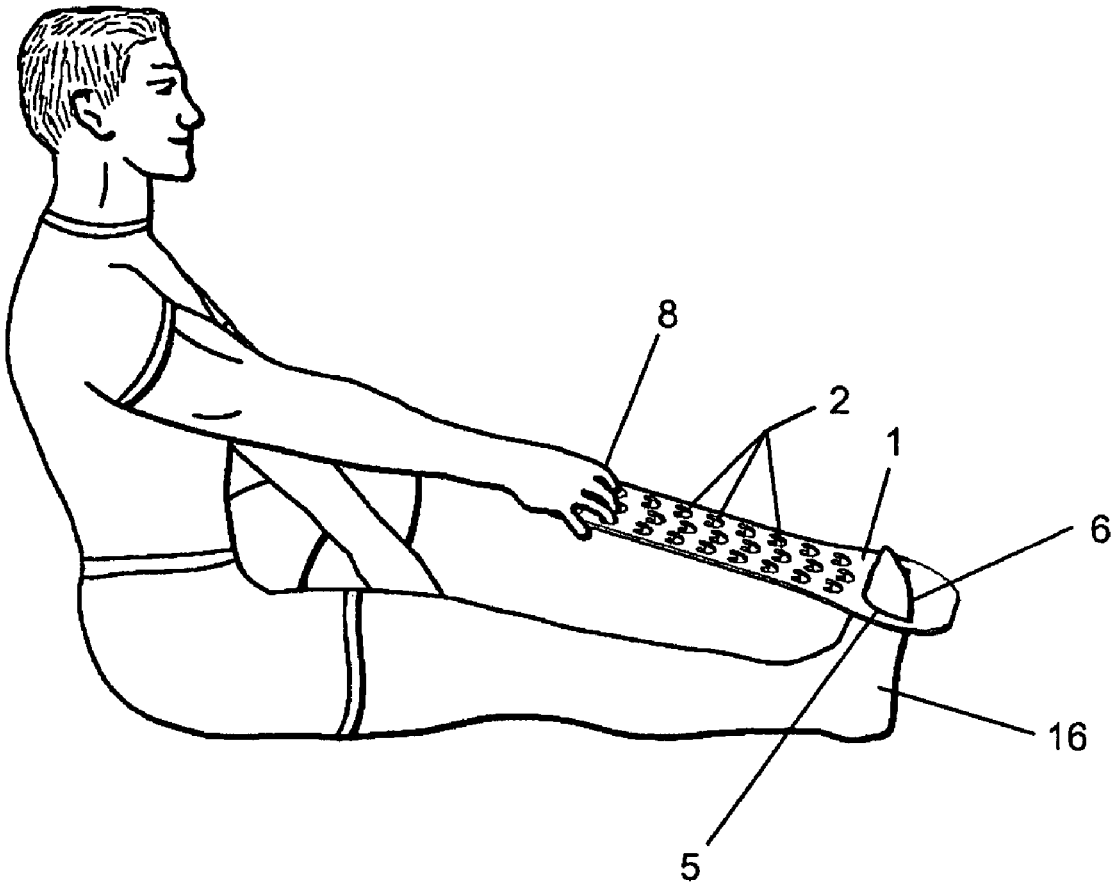
FIG. 5 is a perspective view illustrating a person using the device illustrated in FIG. 1 to stretch the muscles in the legs and back by placing the foot in a stabilizing hole, stretching their torso forward and placing three fingers into apertures, each finger causing a pad to be displaced.

Referring now to the figures: the yoga tension device is shown in FIG. 1. An elongated strap 1 has a major axis 12 is shown comprising a plurality of ladder apertures 2, wherein each aperture comprises an outer edge 3 defining an aperture opening and a pad protrusion 4. The ladder apertures 2 are arranged in rows 10 and columns 14. The number of columns 14 shown in all figures are 3, but may vary in the alternative embodiments as discussed above. The stabilizing opening 5 having a protrusion 6 is shown on the yoga tension device. FIG. 2 shows the pad protrusion 4 extending into the opening of the ladder aperture 2. FIG. 4 shows the tension device with a finger 8 inserted into an aperture 2 causing the pad protrusion 4 to be displaced. FIG. 3 illustrates a person using the device of FIG. 1 to stretch their shoulder muscles. Three fingers 8 are inserted into the apertures 2, causing the pad protrusions 4 to be displaced, as shown in FIG. 4. The first arm 22 is raised over the head, the elbow is bent and the hand is brought to the back of the neck. The second arm 24 is then brought behind the lower back and up between the shoulder blades and the apertures 2 or the stabilizing hole 5 is grasped. Alternatively, to as shown in FIG. 5, stretch muscles in the legs and back, a foot 16 is inserted into the stabilizing hole 5 causing the pad protrusion 6 to be displaced. The user then stretches the torso forward and places three fingers into the apertures 2, each finger 8 causing a pad protrusion 4 to be displaced. A user may increase the tension (i.e., further stretch the muscles) in the strap 1 by climbing their fingers 6 into apertures closer to the leg. It is contemplated that one or more of the features of the embodiment described herein may be beneficially combined.

Throughout this application, various publications and patents and patent applications are referenced. The disclosures of these publications in their entireties are hereby incorporated by reference into this application in order to more fully describe the state of the art.

This invention may be embodied in other forms or carried out in other ways without departing from the spirit or essential characteristics thereof. The present disclosure is therefore to be considered as in all respects illustrative and not restrictive, the scope of the invention being indicated by the appended claims, and all changes which come within the meaning and range of equivalency are intended to be embraced therein.

While the foregoing is directed to the preferred embodiment of the present invention, other and further embodiments of the invention may be devised without departing from the basic scope thereof.

I claim:

1. An exercise device comprising:

a flexible elongated body configured for use as at least one of a yoga device, a stretching device, a physical therapy device or an exercise device;

a plurality of columnar ladder apertures disposed through the body and sized to accommodate a finger, wherein the plurality of ladder apertures are arranged in at least three rows having at least two laterally spaced ladder apertures, wherein at least one row has at least three ladder apertures and wherein the three ladder apertures defining the row are arranged substantially in an arc passing through a major axis of the body;

a first flexible pad protrusion extending into at least one of the ladder apertures, the pad protrusion configured to be displaced by and provide a cushion to a finger entering the ladder aperture; and a second pad protrusion extending into the at least one ladder aperture having the first pad protrusion.

2. The device of claim 1, wherein the ladder apertures defining at least one row are arranged in an orientation substantially perpendicular to a major axis of the body.

3. The device of claim 1 further comprising:

a stabilizing hole formed in a first end of the body.

4. The device of claim 3, wherein the stabilizing hole is elongated.

5. The device of claim 4, wherein the stabilizing hole has an elongated orientation non-parallel to a major axis of the body.

6. The device of claim 5, wherein the stabilizing hole has an open area at least three times an open area of the ladder aperture.

7. The device of claim 1, wherein the ladder apertures further comprise:

a first set of ladder apertures having pad protrusions oriented in a first direction; and a second set of ladder apertures disposed proximate the second end of the elongated body having pad protrusions oriented in an orientation different than the orientation of the pad protrusions extending into the first set of ladder apertures.

8. The device of claim 7, wherein the orientation of the pad protrusions extending into the first set of ladder apertures have a mirror image orientation relative the pad protrusions extending into the second set of ladder apertures.

9. An exercise device comprising:

a flexible elongated body configured for use as at least one of a yoga device, a stretching device, a physical therapy device or an exercise device, the body having a first end;

a plurality of ladder apertures formed through the body and sized to accommodate a finger, at least six of the ladder apertures arranged in two rows of three ladder apertures;

at least one pad protrusion extending into at least one of the ladder apertures, the pad protrusion displaceable by a finger entering the ladder aperture to a position padding the finger from the body;

a stabilizing hole formed through the first end of the body, wherein the stabilizing hole is elongated; and a second pad protrusion extending in the stabilizing hole.

10. The device of claim 9, wherein the stabilizing hole has an elongated orientation perpendicular to a major axis of the body.

11. The device of claim 9, wherein the stabilizing hole has an open area at least three times an open area of the ladder aperture.

12. The device of claim 9, wherein the three ladder apertures defining each row are arranged substantially in an arc passing through a major axis of the body.

* * * * *